US009458681B2

(12) United States Patent
Wijning et al.

(10) Patent No.: US 9,458,681 B2
(45) Date of Patent: Oct. 4, 2016

(54) DRILLING VESSEL

(75) Inventors: Diederick Bernardus Wijning, Schiedam (NL); Olaf Van Der Meij, Voorschoten (NL); Joop Roodenburg, Delft (NL)

(73) Assignee: ITREC B.V., Schiedam (NL)

( * ) Notice: Subject to any disclaimer, the term of this patent is extended or adjusted under 35 U.S.C. 154(b) by 106 days.

(21) Appl. No.: 14/233,099

(22) PCT Filed: Jul. 13, 2012

(86) PCT No.: PCT/NL2012/000050

§ 371 (c)(1),
(2), (4) Date: Feb. 24, 2014

(87) PCT Pub. No.: WO2013/012317

PCT Pub. Date: Jan. 24, 2013

(65) Prior Publication Data

US 2014/0151057 A1 Jun. 5, 2014

(30) Foreign Application Priority Data

Jul. 15, 2011 (NL) ..... 2007125

(51) Int. Cl.

| | |
|---|---|
| ***E02B 17/00*** | (2006.01) |
| ***E21B 7/12*** | (2006.01) |
| ***E21B 15/02*** | (2006.01) |
| ***E21B 43/01*** | (2006.01) |
| ***E21B 19/00*** | (2006.01) |
| ***E21B 19/06*** | (2006.01) |
| ***E21B 19/10*** | (2006.01) |

(52) U.S. Cl.

CPC ..... *E21B 19/004* (2013.01); *E21B 19/006* (2013.01); *E21B 19/06* (2013.01); *E21B 19/10* (2013.01)

(58) Field of Classification Search

None

See application file for complete search history.

(56) References Cited

U.S. PATENT DOCUMENTS 3,498,392 A * 3/1970 Gordon ..... E21B 15/02 175/5
4,365,787 A 12/1982 Latimer
5,395,182 A * 3/1995 Rossburger ..... E01C 19/27 404/122

(Continued)

FOREIGN PATENT DOCUMENTS

GB 2281578 A 3/2005
WO WO 2008/048163 A1 4/2008

(Continued)

*Primary Examiner* — Matthew R Buck
*Assistant Examiner* — Douglas S Wood
(74) *Attorney, Agent, or Firm* — Birch, Stewart, Kolasch & Birch, LLP

(57) ABSTRACT

A drilling vessel with a drilling deck includes a drilling vessel floor structure defining the drilling deck and a tubular support assembly that is recessed in the drilling floor structure. The assembly includes a support frame and at least two support tables, wherein the tables have a top surface that forms part of the drilling deck. The tables are each guided by the support frame to allow displacement along a line between an active position for supporting a tubular and a retracted position for passing an object. The tables and the adapters segments supported thereby are coupled, for example via a clamp or a shape-coupling, such that when the tables move from their active position into their retracted position each segment moves with the respective table it is coupled with and the bushing is opened up for passing through an object through the opening between the at least two support tables and the adapter segments they support.

19 Claims, 6 Drawing Sheets

(56) References Cited

U.S. PATENT DOCUMENTS

| | | | | |
|---|---|---|---|---|
| 5,395,183 | A * | 3/1995 | Watkins | E21B 19/004 166/350 |
| 7,216,717 | B2 * | 5/2007 | Severin | E21B 19/06 166/379 |
| 7,628,225 | B2 * | 12/2009 | Petersson | E21B 15/02 166/341 |
| 2005/0000696 | A1 | 1/2005 | McDaniel et al. | |
| 2006/0191689 | A1 | 8/2006 | Severin et al. | |
| 2010/0116507 | A1 * | 5/2010 | Haugland | E21B 19/002 166/352 |
| 2010/0147528 | A1 | 6/2010 | Baugh | |
| 2014/0190386 | A1 | 7/2014 | Wijning et al. | |

FOREIGN PATENT DOCUMENTS

| | | | |
|---|---|---|---|
| WO | WO 2008/121071 | A1 | 10/2008 |
| WO | WO 2011/136801 | A1 | 11/2011 |

* cited by examiner

DRILLING VESSEL

TECHNICAL FIELD AND BACKGROUND OF THE INVENTION

The invention relates to a drilling vessel. The invention furthermore relates to a method for constructing a riser string. More specifically, the invention relates to a drilling vessel with a drilling deck and a tubular support structure such as a riser spider.

When assembling and de-assembling a riser string on an offshore drilling vessel, the riser string is typically supported from a riser spider in the drilling opening. The riser spider is often placed on a gimbal, located between the riser spider and the drilling deck. The gimbal is used to compensate for the movement of the vessel and evenly distributes loads on the riser spider and the riser supported by it.

The riser spider has a support opening for receiving the riser. Sliding dogs are used to adapt the support opening of the riser spider to fit the diameter of the tubular sections of the riser. Alternatively, bushings are used for adapting the size of the support opening.

Risers are composed out of multiple tubular sections that are coupled to each other via sockets, coupling sleeves or flanges. These couplings typically have a diameter larger than the diameter of the tubular sections of the riser, and are used to hang of the riser on the bushing or dogs.

When lowering a riser through the drilling opening the bushings, and sometimes even the riser spider, are temporarily removed to allow the passing of the wider parts such as the couplings and inserts provided in the riser string. Removing and re-installing of the bushings and the riser spider is time consuming and difficult in the restricted space of the drilling deck above the drilling opening. This is in particular the case when assembling and de-assembling a riser string from riser segments, which involves alternatingly supporting the riser string and passing a riser segment or insert through the drilling opening.

SUMMARY OF THE INVENTION

It is an object of the invention to provide an alternative apparatus for supporting a riser string. It is a further object of the invention to obviate or reduces the problems described hereinabove. According to the present invention, this object is achieved by a drilling vessel according to claim 1 and a method according to claim 10.

The invention provides a drilling vessel with a drilling deck, according to claim 1. The vessel comprises a drilling vessel floor structure defining a drilling deck. In the drilling vessel floor structure is recessed a tubular support assembly. The tubular support assembly has a support frame and at least two support tables, which tables each have a top surface that forms part of the drilling deck. Thus, the crew can walk from the drilling deck defined by the floor structure onto the drilling deck section formed by the top surface of the tables without mounting steps or stairs or otherwise negotiating a height difference. Preferably the top surface of the tables is substantially flush with the drilling deck such that objects, for example an insert, can be moved by trolley from the drilling deck defined by the floor structure onto the drilling deck section formed by the top surface of the tables. The tables are each linearly guided by the support frame to allow displacement of the tables along a line between an active position and a retracted position. The lines of movement intersect at a common centre point.

The tables are each provided with a recess. When the tables are in the active position, the recesses face the common centre point such that the recesses together define a support opening. In this position the tables furthermore provide a deck around the support opening. The common centre point of the lines of movement preferably coincides with the centre of the support opening, such that when the tables are moved from their active position, they at least initially move in a radial direction. The radial movement facilitates engaging and disengaging a riser supported in the support opening. The assembly further comprises multiple exchangeable adapter segments for adapting the support opening to the size and shape of the tubular to be supported therein. At least one adapter segment is carried in each recess of the support tables, such that, when the supporting tables are positioned in their active position, the exchangeable segments together form a bushing for supporting the tubular.

Furthermore, the tables and the adapter segments supported thereby are coupled, for example via a clamp or a shape-coupling, such that when the tables move from their active position into their retracted position each segment moves with the respective table it is coupled with and the bushing is opened up for passing through a coupling or insert.

With known riser spiders, the pass through opening that is created by removing the bushing or by retracting the dogs is just large enough to pass a typical coupling section of a riser string. If anything of a larger size is to be lowered through the drilling opening, such as an insert mounted in the riser string, the riser spider has to be removed from its position above the drilling opening. With a drilling vessel according to the invention, a pass through opening large enough to pass through an insert can be created without removing the bushing or the riser spider. Thus, for example an insert such as an SBOP can be passed through the opening between the at least two support tables and the adapter segments supported thereby when the tables are in their retracted position.

Furthermore, because the support frame is recessed in the drilling deck, the larger pass through opening is achieved without taking up additional space on the drilling deck.

Furthermore, since the adapter segments are coupled to the sliding tables, moving the tables into their retracted position suffices for providing the enhanced pass through opening. When passing segments of a tubular having a diameter larger than the inner diameter of the bushing, it is thus not necessary to lift the adapter segments from the opening and temporarily store them on the drilling deck. This facilitates lowering a segment of a wider cross section or an insert from the drilling deck through the drilling opening.

In a further embodiment according to the invention, the tubular support assembly is a riser spider and gimbal assembly for supporting tubulars, in particular risers, which riser spider and gimbal assembly is recessed in the drilling floor structure. The riser spider comprises the support frame and the support tables, which tables are each guided by the support frame to allow displacement between the active position and the retracted position, and is supported by the gimbal. Preferably, two tables are used, which are each linearly guided by the frame, Thus the support frame can be compact which facilitates locating the frame within the drilling floor structure. The tables are both provided with a semi circular recess, which recesses face each other such that when the tables are in their active position the recesses define a support opening in which they can together support the bushing, more in particular the exchangeable segments forming said bushing for supporting a tubular, more in particular a riser. The gimbal is arranged between the riser spider and the drill floor structure and moveably supports the support frame and thus the two support tables guided by that frame. In this embodiment, the drilling vessel floor structure defining the drilling deck is configured to support the gimbal below the drilling deck in stead of on the drilling deck, more in particular to support the gimbal such that the top surface of tables of the riser spider form part of the drilling deck, preferably are substantially flush with the drilling deck.

Thus, the tables each have a top surface that forms part of the drilling deck such that the crew can walk from the drilling deck defined by the floor structure onto the drilling deck section formed by the top surface of the tables without mounting steps or stairs. When the top surface of the tables is substantially flush with the drilling deck a trolley can be driven from the drilling deck defined by the floor structure onto the drilling deck section formed by the top surface of the tables without the need of a ramp or similar structure.

A drilling vessel according to the invention thus facilitates passing wide sections of a supported tubular through the support opening. Furthermore, this is achieved without taking up extra space on the drilling deck. This is particular the case for the embodiment comprising the riser spider gimbal assembly, which facilitates passing wide sections of a riser string in combination with movably supporting a riser string and providing more space on the drilling deck compared to the prior art.

The invention further provides a method according to claim 10 for constructing a riser string using a drilling vessel according to the invention.

Advantageous embodiments of the drilling vessel according to the invention and the method according to the invention are disclosed in the subclaims and in the description, in which the invention is further illustrated and elucidated on the basis of a number of exemplary embodiments, of which some are shown in the schematic drawing.

DETAILED DESCRIPTION

First, the invention will be further elucidated on the basis of the exemplary embodiment as shown in FIGS. 1-7. Thereafter, some particular alternative embodiments will be described, shown in FIGS. 8*a* and 8*b*.

Figure 1:
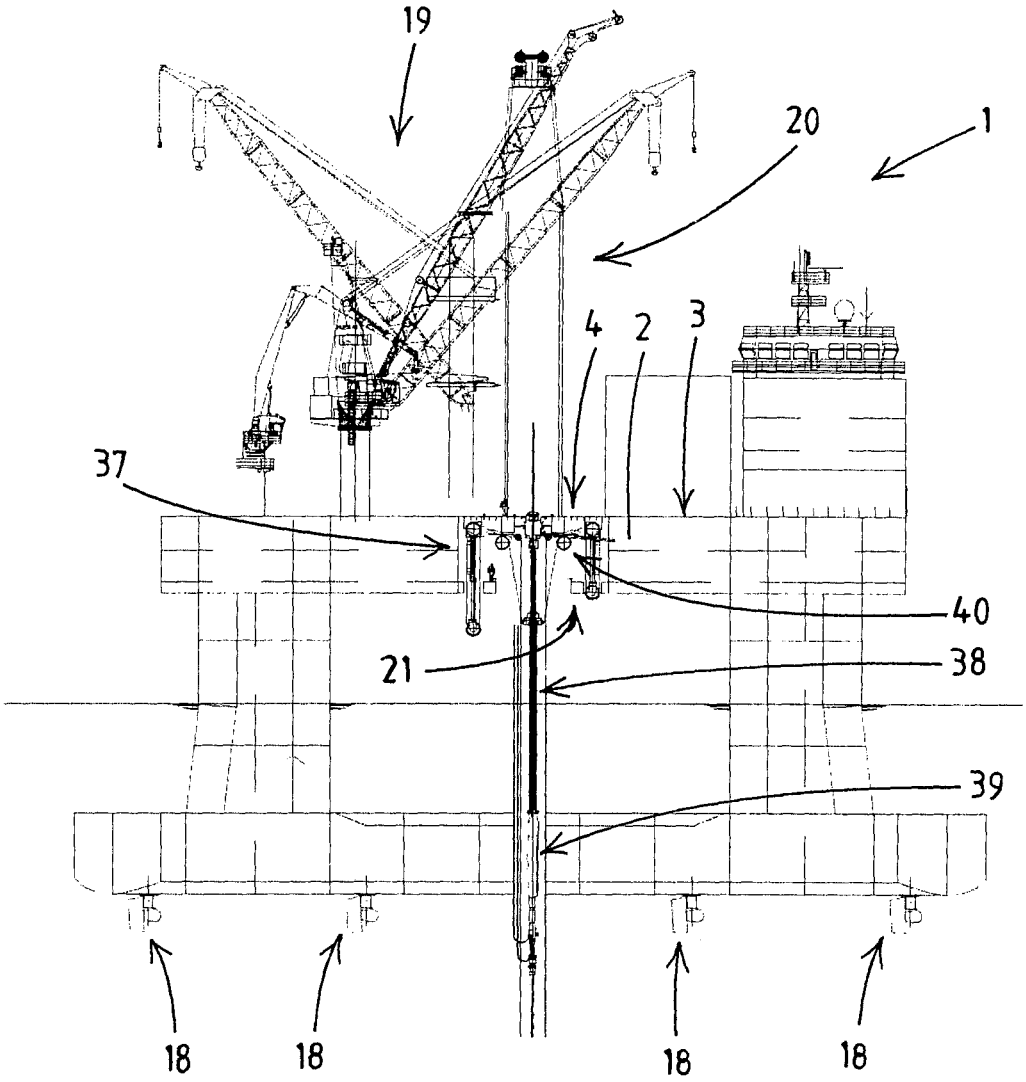
FIG. 1 shows a side view, partially in cross section, of a drilling vessel comprising a drilling vessel floor structure and a tubular support assembly according to the invention.

FIG. 1 shows a drilling vessel 1, more in particular a floating offshore drilling platform, comprising a drilling vessel floor structure 2 defining a drilling deck 3. In the embodiment shown, below the drilling deck 3 a cellar deck 21 is provided that runs along the sides of the drilling opening 40. Furthermore, a heave compensation system 37 is provided, also located below the drilling deck.

The vessel 1 is provided with several propulsion members 18 and suitable dynamic positioning equipment to allow dynamic positioning of the vessel 1. The vessel 1 in the particular embodiment shown further has cranes 19 for handling objects. Cranes can also be used for handling riser sections. In the embodiment shown a multi purpose drilling tower 20 is located above the drilling opening 40 in the drilling deck 3. In an alternative embodiment another type of drilling apparatus, such as a derrick, can be provided. Also, the invention can be combined with another type of drilling vessel.

Figure 2:
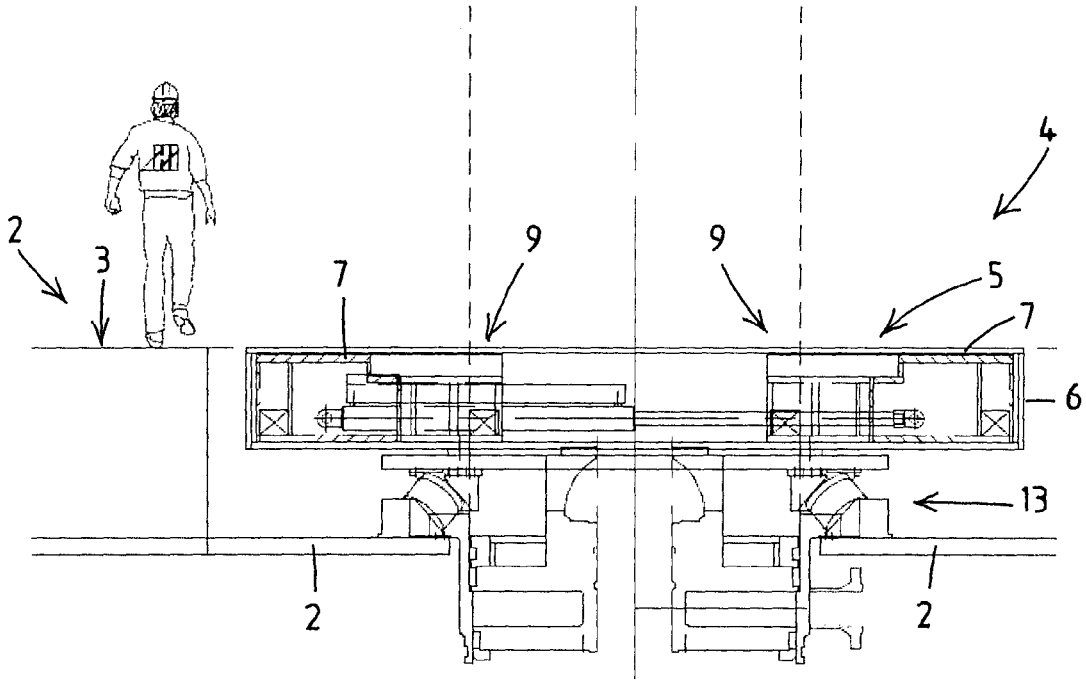
FIG. 2 shows in cross section the drilling vessel floor structure of FIG. 1, the floor structure comprising a riser spider and gimbal assembly according to the invention.
Figure 3:
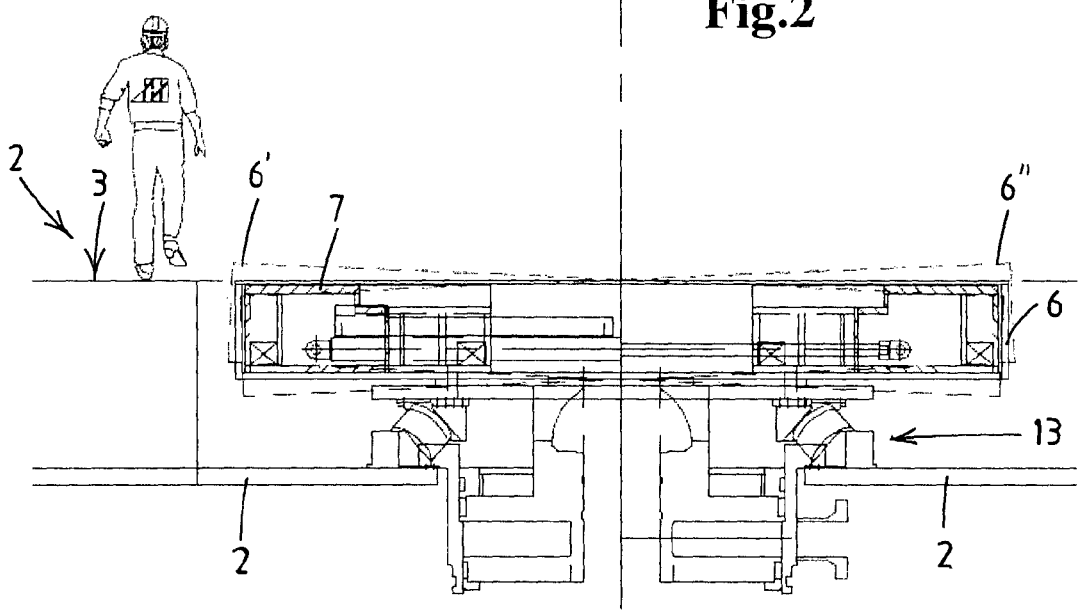
FIG. 3 shows a window of movement of a support frame from the riser spider and gimbal assembly of FIG. 2.
Figure 4:
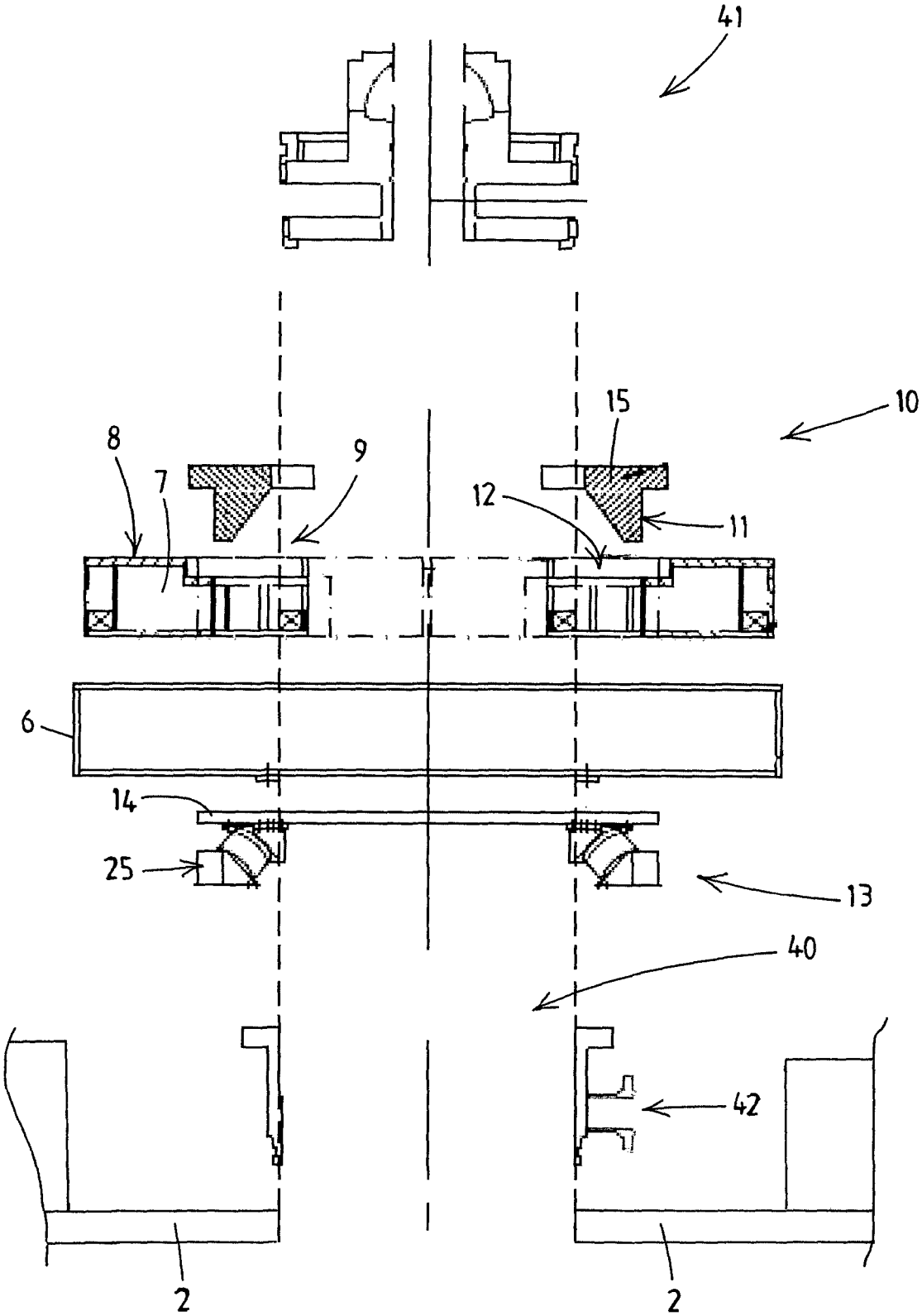
FIG. 4 shows an exploded view of the riser spider and gimbal assembly of FIG. 2.

The floor structure 2 comprises a riser spider and gimbal assembly 4 that is shown in more detail in FIGS. 2, 3 and 4. The riser spider and gimbal assembly 4 supports a riser string 38, which riser string comprises an insert 39, more in particular an SBOP. It is noted that of this riser string only an upper section is shown in FIG. 1. The riser spider and gimbal assembly 4 comprises a riser spider having a support frame 6, two support tables 7 movably supported in the frame 6, and a gimbal 13 that moveably supports the support frame and thus the two support tables guided by that frame. The gimbal 13 is in turn supported by the drilling floor structure 2 defining the drilling deck 3.

In an alternative embodiment, the support frame and the support tables are directly supported by the drilling vessel floor structure, and no gimbal is provided.

In the embodiment shown, the tables 7 of the spider assembly have a top surface 8 forming part of the drilling deck 3. The riser spider and gimbal assembly 4 is recessed in the drilling floor structure 2 such that the top surface 8 of the tables form an extension of the drilling deck 3 defined by the floor structure 2. Preferably the riser spider and gimbal assembly 4 is supported by the drilling vessel floor structure 2 such that the top surface 8 of the tables is substantially flush with the drilling deck 3, as shown in FIG. 2.

The tables 7 are each moveably supported by the frame 6 of the riser spider 5, in the particular embodiment shown are linearly guided by the support frame, to allow displacement of the tables between an active position, shown in FIGS. 2 and 3, and a retracted position.

The tables are supported such that they can be moved parallel to the surface of the drilling deck 3. Thus, the tables are located within the drilling floor structure when in their active position and when in their retracted position. The tables therefore do not take up any space on the drilling deck, and do not hinder operations or personnel on the drilling deck.

Figure 5:
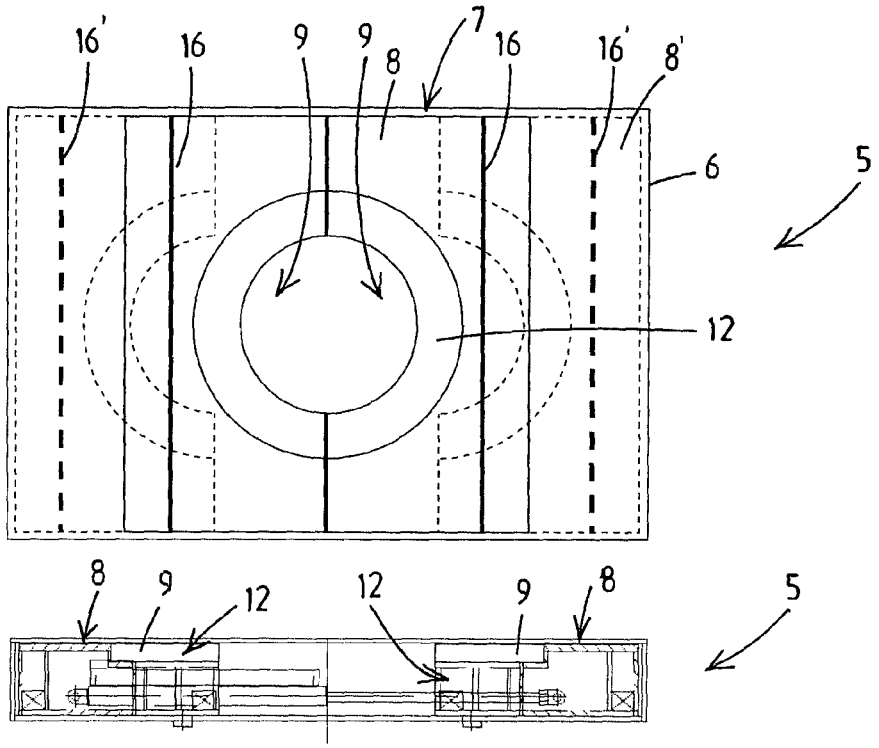
FIG. 5 shows a top view and a side view of the support frame with two support tables of the riser spider and gimbal assembly of FIG. 2.

The tables 7 are both provided with a semi circular recess 9, as is shown in the top view of the frame and tables in FIG. 5. In FIG. 5, the tables are shown in both the active position, in full lines, and the retracted position, in dotted lines. The lower part of FIG. 5 shows, in side view in cross section, the frame with the tables in the retracted position. The recesses 9 face each other such that when the tables 7 are in their active position, and are located adjacent each other, the recesses define a support opening in which they can together support a bushing 10 for supporting a riser string in that opening. In the particular embodiment shown, a cut out 12 is provided in the top surface of the tables 7, more in particular in the recess 9, for receiving a flange 11 of a bushing 10 as an intermediate between the tables and a riser segment of the riser string.

Preferably, the tables in their active position define a support opening having a diameter of about 60.5 inch for supporting a bushing that reduces said opening to about 49.5 inch or about 37.5 inch. Thus the device is able to support the most common types of riser spiders. Other bushings can be used for supporting a tubular of different dimensions.

When the tables are in their retracted position, shown in the top view in FIG. 5, the tables define an opening between them for passing through objects. This opening is substantially larger than the support opening for supporting a bushing.

Preferably, the two tables in their retracted position define a pass through opening between the tables of at least about 80 inch between them, preferably about 90 inch or more, such that a riser string insert can be passed through said opening.

The gimbal 13, arranged between the riser spider 5 and the drill floor structure 2, moveably supports the support frame 6 and the two support tables 7 guided by that frame. It is designed to reduce shock and to evenly distribute loads on the spider and the risers supported by the spider. The gimbal 13, shown separately in FIG. 6, in this exemplary embodiment comprises a rectangular support frame 14 with bearings 15 at its corners.

The central opening of a gimbal according to the invention preferably has substantially the same width as the opening defined between the two tables when in their retracted position.

The opening is thus large enough for passing objects having a diameter larger than the diameter of a flange of a riser section.

In a preferred embodiment according to the invention, the central opening in the gimbal is at least about 80 inch, preferably about 90 inch or more, such that a riser string insert can be passed through said opening.

In the embodiment shown, the riser spider and gimbal assembly is positioned such that the top surface of its tables is flush with the surface of the drilling deck. Thus, the crew can simply walk from the drilling deck defined by the floor structure onto the drilling deck section formed by the top surface of the tables and a trolley can be driven from the drilling deck defined by the floor structure onto the drilling deck section formed by the top surface of the tables without the need of a ramp or similar structure.

In particular, the gimbal compensates for movement of the drilling floor structure, due to for example the rocking of the drilling vessel on the waves, relative to the riser spider and the riser it supports. FIG. 3 the range of movement of the frame 6, supported by the gimbal 13, relative to the drilling deck is depicted. In dotted lines the extreme positions 6', 6" of the frame 6 are indicated. Under normal conditions, the movement of the drilling floor structure relative to the frame is limited, and the frame is positioned in a rest position with the tables substantially parallel to the drilling deck, shown in FIG. 2. The tables 7 of the riser spider are both provided with a semi circular recess 9 for supporting a bushing 10. Preferably, the bushing 10 comprises two exchangeable adapter segments that together form a bushing for supporting a riser. With the riser spider according to the invention, each segment is carried in a recess of the support tables. Thus, the exchangeable segments together form a bushing when the supporting tables are positioned in their active position.

Preferably, the bushing is formed by two semi circular segments. In this embodiment each segment is located in the recess of a table, its flange supported by the table top surface, such that when the tables move into their retracted position each segment moves with the respective table and the bushing opens up for passing an object, such as a riser, through the opening between the tables. Thus the bushing, more in particular the segments forming the bushing, do not need to be taken out of the riser spider and stored on the drilling deck for allowing a riser to pass through the riser spider. This saves time, since for example a riser string can be assembled more quickly. It furthermore saves effort, since no cranes are needed for lifting the segments out of the riser spider. It furthermore saves space, since the bushing segments do not need to be stored on the drilling deck or elsewhere on the drilling vessel.

Figure 7:
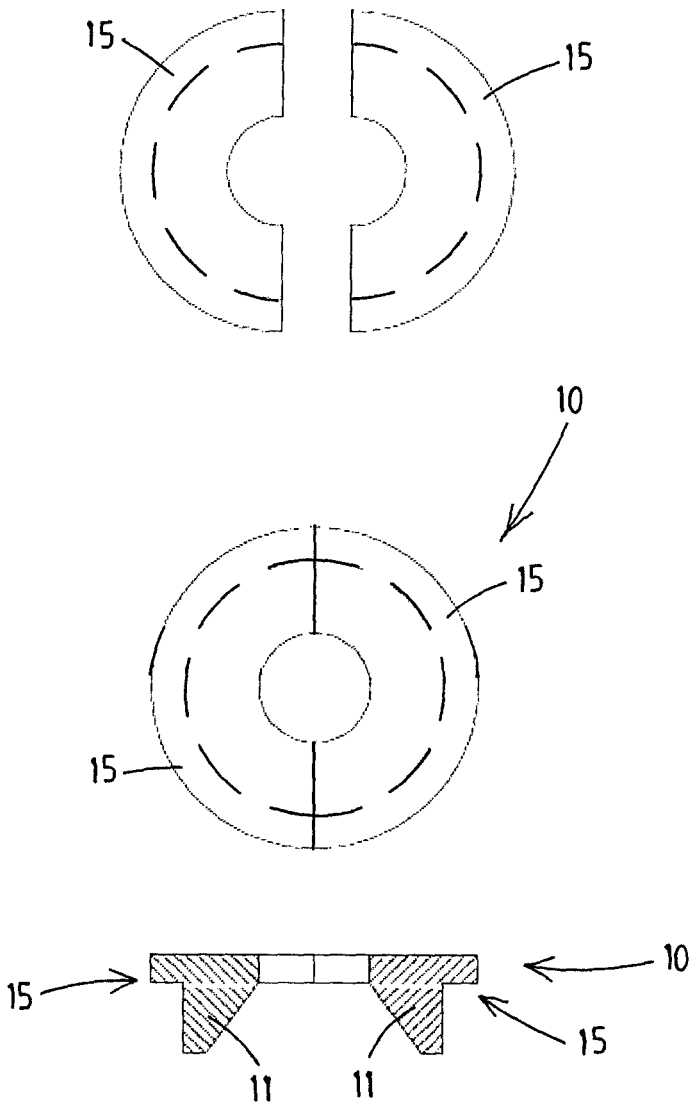
FIG. 7 shows different views of two exchangeable adapter segments for use in the riser spider and gimbal assembly of FIG. 2.

FIG. 7 shows two exchangeable adapter segments 15, together forming a bushing 10. When located in the riser spider 5, the tables 7 support the flanges of the bushings 10. In the particular embodiment shown, the top surface 8 of the tables 7 is provided with a cut out 12 for engaging the flange of a bushing. In the embodiment shown flanges and cut out have a semi circular contour. Furthermore, the recess and inserts are designed such that the top of the inserts, more in particular the top of the flanges of the inserts, are substantially level with the top surface of the tables. It is observed that other forms are also possible, for example a bushing having a flange with a rectangular contour.

In a further embodiment, the tables each comprise a coupling device, for example a clamp or an opening for inserting a pin, for coupling an exchangeable segment to the table such that when the tables move into their retracted position each segment moves with the respective table and the bushing is opened for passing through an object.

In an alternative embodiment, the flange of the bushing is at its bottom surface, i.e. the surface facing the top surface of the table, provided with one or more protrusions for interacting with one or more cut outs in the surface of the table. Thus, when the segment is supported by the table, the one or more protrusions and the one or more cut outs interlock to prevent the bushing from movement relative to the table in a direction parallel to the top surface of the table.

In the particular embodiment shown, a cut out 12 is provided in the top surface of the tables 7 for receiving a flange 11 of a bushing 10, which flange extends in a downward direction when the insert 15 forming part of the bushing, is placed in the table. Preferably, the tables in their active position define a support opening having a diameter of about 60.5 inch for supporting a bushing that reduces said opening to about 49.5 inch or about 37.5 inch. By using the bushing, the opening in the riser spider can be adapted to different sizes of riser sections.

FIG. 4 shows an exploded view in cross section of the riser spider and gimbal assembly shown in FIGS. 2 and 3. The figure shows the drilling vessel support structure 2, the gimbal 13, the support frame 6, the tables 7 and the exchangeable adapter segments 15 for forming a bushing. The figure furthermore shows a diverter 41 and a diverter support 42 for mounting the diverter below the riser spider and gimbal assembly, as shown in FIGS. 2 and 3. It is noted that in the preferred embodiment shown, the riser spider and gimbal assembly 4 and the diverter 41 are dimensioned such that the diverter can be lowered into its mounted position via the opening between the retracted tables of the riser spider.

In a preferred embodiment, at least one of the tables is provided with guide rails along a topside surface, which guide rails are positioned in line with guide rails provided on the drilling deck, for moving an object, such as a riser string insert, over the rails from a temporarily storage position on the drilling deck into an insert position above the support opening.

In the particular embodiment shown, each table is provided with a guider rail 16 extending along its top surface, see FIG. 5. When the tables are in their active position, the guider rails are positioned in line with guide rails provided on the drilling deck (not shown) and thus form a track for moving an object over the rails from a temporarily storage position on the drilling deck into an insert position above the support opening. The object may for example be provided with slides for interacting with the rails or the object can be mounted on for example a trolley supported by the rails.

In a further embodiment, locks are provided for locking the support frame in a fixed position relative to the floor structure such that a top surface of each table is and remains parallel to the drilling deck, as shown in FIG. 2. For example, movable pins can be provided in the drilling vessel floor structure, which can be moved in a horizontal direction, into openings in the support frame to fix the position of that frame relative to the drilling floor. Locking the frame in this rest position is especially useful when objects are to me moved from the drilling deck onto the riser spider, or visa versa. In particular when the objects are slid or driven over rails on the drilling deck and top surface of the tables, locking the frame in the rest position prevents the movement of the frame blocking transport of the object, or even damaging or turning over of on object due to movement of the drilling deck relative to the riser spider.

In a further embodiment a device is provided for positioning the frame in the rest position, for example by providing movable supports which engage the support frame from below to support it in said position. Once supported in its rest position, the locks can be engaged more easily since there is no movement of the frame relative to the drilling floor. In an alternative embodiment, the frame is supported in the rest position, and no additional locks are used for fixing the support frame to the floor structure, during the transport of objects from the deck onto the riser spider and visa versa.

In a further embodiment, locks are provided for locking the tables within the support frame in the retracted and/or active position. Preferably the tables can be locked in the active position such that the actuators that moved the tables in said position can be switched off or removed while the tubular support supports for example a riser string.

A drilling vessel floor structure defining a drilling deck and comprising a riser spider and gimbal assembly as disclosed above, allows for constructing a riser string in a time saving manner according to the invention.

As a first step, this method comprises providing multiple riser sections, each having a flange adapted to be engaged by a riser spider, more in particular by a bushing carried by that riser spider. The riser sections are to be combined to form the riser string.

To allow for supporting a riser section, the tables are moved into their respective active positions for defining the support opening. Subsequently, two exchangeable adapter segments are placed in the support opening such that each is carried in a recess of the support tables, which exchangeable segments together form a bushing, In an alternative embodiment, the exchangeable adapter elements are placed in the recesses of the tables prior to moving the tables in their active position.

The exchangeable adapter segments are chosen to form a bushing that fits the riser sections to be supported, and preferably reduces the support opening defined by the tables in their support position from an about 60.5 inch diameter to an about 49.5 inch or an about 37.5 inch diameter. Thus standardised riser segments can be supported.

It is observed that for adapting the support opening to the size and shape of the tubular to be supported therein, at least a set of segments for forming one bushing is provided. Preferably, multiple sets of adapter segments are provided, each set forming a bushing with a specific diameter. Thus, by changing the set of segments supported by the tables, the diameter of the support opening can be adapted to fit a particular size of tubulars, for example riser sections. For example, a riser string can be composed out of riser sections having a diameter of about 49.5 inch or of riser sections having a diameter of about 37.5 inch, etc. Alternatively, different bushings, each composed out of segments, are concentrically combined, or nested, to reduce the support opening formed by the tables to a size and shape fit for supporting a particular riser.

Preferably, adapter segments are provided for supporting the riser sections of a riser string, but also sets can be provided for supporting other tubulars, for example casing, tubing or drilling string. Other tubulars can also be hang off in the tubular support using slips or pivots for adapting the size of the support opening.

When the tables are in their active position and together support the bushing composed out of the exchangeable adapter elements, a first riser section is lowered into the bushing. The riser is lowered into a support position in which the flange at the top end of the riser section is supported by the bushing in the riser spider.

Subsequently, another riser section is located above the riser section in the support position.

The second riser section is attached to the top end flange of the riser section in the support position. When the two risers are connected to each other, the first riser section, and thus the second riser section connected thereto, is lifted from its support position.

When the riser section is no longer supported by the tables of the riser spider, the tables are moved towards their retracted positions. With the tables, the exchangeable adapter segments carried by the tables are moved from under the flange of the riser. When the opening between the tables, and between the adapter elements they support, is wide enough for passing through the flange of the riser section, the riser section is lowered through the opening between the tables.

After the flange of the first riser section has been lowered through the opening, the tables are moved into their respective active positions such that the exchangeable adapter elements carried by the tables again form a bushing for receiving and supporting the flange of the second riser section.

The combined riser sections are lowered until the second riser section is in a support position, i.e. with its flange supported by the rise spider.

By repeating the above process the method can be used to provide a riser string composed out of multiple riser sections. It is observed that the tables and inserts are moved relative to the drilling vessel floor structure to form the opening through which the riser is lowered and are not removed to form that opening. Thus, sliding of the tables is sufficient for providing an opening for passing through the riser and an opening for supporting the riser.

In addition to composing a riser string, a drilling vessel floor structure defining a drilling deck and comprising a riser spider and gimbal assembly according to the invention, also facilitates providing a riser string insert in a riser string.

Such a process may start with moving the riser string insert from a temporarily storage position on the drilling deck into an insert position above a riser section in a support position. The object, or 'riser string insert', is for example skidded, slid on slides or driven on a cart or trolley, preferably over rails located on the drilling deck and the riser string, from the drilling deck onto the spider.

Preferably, the frame supporting the tables is locked in a fixed position relative to the drilling floor structure such that a top surface of each table is parallel to the drilling deck while moving the riser string insert to be inserted into the insert position. This facilitates moving the riser string insert to be inserted from a storage position on the drilling deck into a position on the riser spider for attaching the riser string insert to a riser string section since the riser string insert can not be blocked or damaged by the movement of the frame relative to the floor structure during the transition from deck to riser spider.

In alternative embodiment, the riser spider is not locked to the floor structure in a fixed position, but is supported from below in a position with the top surface of the tables parallel to the drilling deck. For example, extendable supports may be provided between the support frame and the drilling floor structure at the corners of the support frame. By extending the supports, the corners of the support frame are each moved in a position supporting the frame with the tables in the correct position. The supports are for example integrated in the riser spider, or in the deck support structure.

When the riser string insert is on the riser spider, the frame can be unlocked again.

In some situations, fixing the position of the support frame relative to the floor structure and thus the drilling deck is not needed. For example, when movement of the support frame relative to the floor structure is only limited because a calm sea with no or only small waves. Also, when the riser string insert to be inserted on the riser spider is brought in position on the riser spider by crane it may not be necessary to fix the movement of the support frame relative to the drilling deck.

When the insert, more in particular riser string insert, is located on the riser spider it is attached to the top end flange of the riser section in the support position. When attached, the combined riser string and the riser string insert are lifted, such that the riser string section is moved from its support position.

Then, the tables are moved from their respective support positions into their respective retracted positions to allow passing of the riser string insert through the opening between the tables, c.q. between the exchangeable adapter sections supported by the tables.

The riser string insert is lowered through the opening between the tables, after which the tables are moved from their respective retracted positions into their respective support positions to engage a flange of the riser string insert, or a flange of a riser section provided on the insert, and supporting the riser string insert in a support position.

Now a riser string section, or another riser string insert, can be coupled to the riser string insert supported by the riser spider.

When the riser string sections and the riser string insert are combined, and the riser string is ready, the top end of the riser string is lowered through the opening between the tables, which tables are located in their retracted position, and lowered into a heave compensation system below the drilling deck.

By using the drilling vessel floor structure comprising a riser spider and gimbal assembly recessed in the drilling floor structure according to the invention, the riser string can be composed without the need of removing the riser spider, and sections can be passed through the riser spider without the bushing to be lifted from the support opening.

Furthermore, the riser spider and gimbal assembly can remain in place after the drilling string is finished, for example during drilling operations, which again saves time and space compared to removing the riser spider and the gimbal from the drilling deck an transporting them to storage elsewhere on the vessel.

It is observed that the drilling deck is typically the top deck of a drilling vessel such as a semisubmersible drilling platform. It is observed that the drilling vessel floor structure may comprise a sub deck below the drilling deck, the space between both decks being used for locating equipment, and the drilling deck being the walking deck used by the crew. In such an embodiment, the support frame supports the tables with their top surface such that they form part of the drilling deck, and slide over or above the sub deck. In an embodiment, the support frame is at least partially located in the space between the sub deck and the drilling deck.

In a further embodiment according to the invention, the support frame extends within the drilling vessel floor structure, with at least a section of the frame locate below the drilling deck such that when the tables move from their active position into their retracted position, at least part of the top surface of the tables slides below a the drilling deck. Preferably, the drilling deck is substantially flush with the top surface of the tables, i.e. the height difference between the drilling deck and the table top surface is less than the thickness of the tables themselves. This to provide a drilling deck that allows for easy movement of persons and objects from a location on the fixed part of the drilling deck to a position of the drilling deck defined by the top surface of the tables.

In a further preferred embodiment, the tubular support assembly unit further comprises actuators, preferably hydraulic or pneumatic cylinders, for moving the tables between their active position and their retracted position. Preferably, the support frame houses the actuators. In a further embodiment, the actuators are provided between the tables and the frame for moving the tables relative to the frame. It is observed that in the preferred embodiment shown, the tables are guided, for example by guides or rails, in a substantial linear direction. In an alternative embodiment, the tables are for example guided by a rod mechanism and moved along a substantially linear trajectory or along a curved trajectory, The line of movement preferably extends in a plane parallel to the drilling deck such that the top surfaces of the tables move parallel to the drilling deck and preferably form part of that deck in both the active position and the retracted position.

In a preferred embodiment, the frame is a rigid box type structure housing the sliding tables in both their active and their passive position, such that the tables slide within the frame. In a further preferred embodiment, the actuators are hydraulic or pneumatic cylinders provided within that frame connected with one end to a sliding table and with an opposite end to the frame. Thus, the actuators do not subject the drilling vessel floor structure to pulling or pushing forces when moving the tables. This embodiment is especially suited for combination with the gimbal.

Preferably, the opening between the tables in their retracted position allows for passing through a diverter. In a further embodiment, the support frame is at its bottom side provided with attachment means for connecting a diverter to the frame. In a further embodiment the drilling vessel support structure is provided with supports for receiving a diverter lowered through the opening between the tables in their retracted position, as is shown in FIGS. 2 and 3. Thus, the drilling floor support structure according to the invention facilitates installing a diverter below the drilling deck.

In a further embodiment, the tubular support assembly forms a unit that is removably mounted in the drilling floor structure, such that it can be removed for example by lifting it by crane from its recessed position within the drilling floor structure. Providing the tubular support assembly as a removable unit facilitates replacing the unit with another unit, for example when the unit is up for maintenance or for replacing the unit having a gimbal for supporting short riser string with a unit comprising a heavy duty gimbal for supporting long riser strings.

Figure 6:
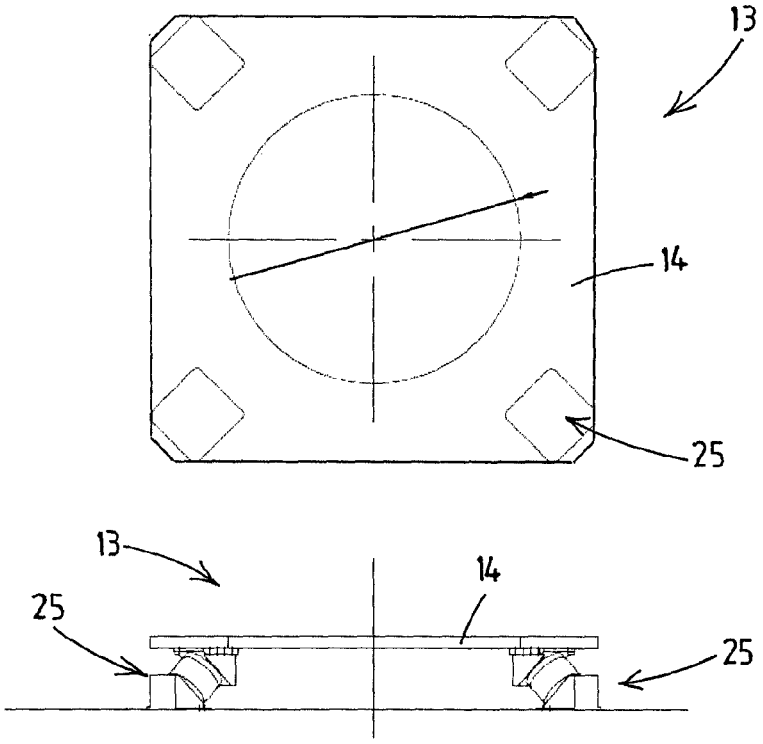
FIG. 6 shows a top view and a side view of the gimbal of the riser spider and gimbal assembly of FIG. 2.

In the exemplary embodiment with the riser spider and gimbal assembly, the particular gimbal shown is provided with a rectangular contoured frame having a central opening with a circular shape, see FIG. 6. It is observed that gimbals as such are known in the art, and other configurations of the gimbal can also be used to provide a riser string and gimbal assembly according to the invention. For example, a gimbal with a circular contoured frame, having a rectangular opening, etc. Furthermore, the type and number of bearings of the gimbal may be adapted to fit a particular use of the riser spider and gimbal assembly, for example a heavy duty use for supporting riser strings in oceans of great depths, or light duty for supporting riser strings in oceans of limited depth.

In a further preferred embodiment, the drilling vessel floor structure also supports a heave compensation system below the support opening, such that a riser string composed in the assembly can be lowered into for engagement with the heave compensation system.

Figure 8A:
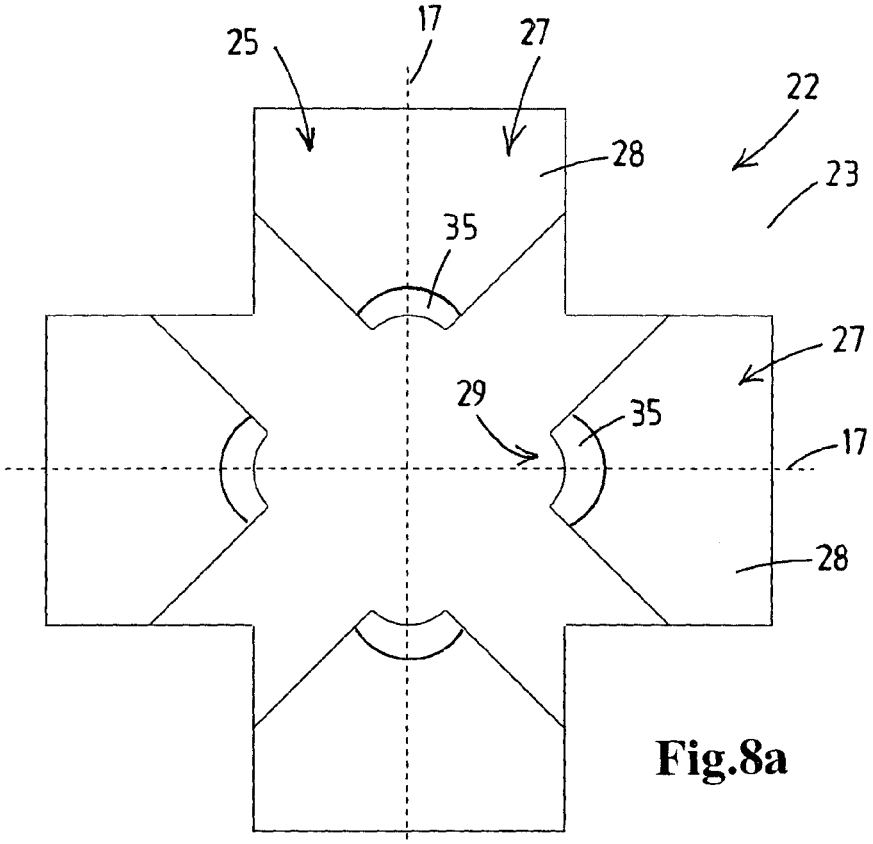
FIGS. 8*a* and 8*b* show top views of an alternative embodiment of a drilling vessel floor structure and a tubular support assembly of a drilling vessel according to the invention in different working positions.
Figure 8B:
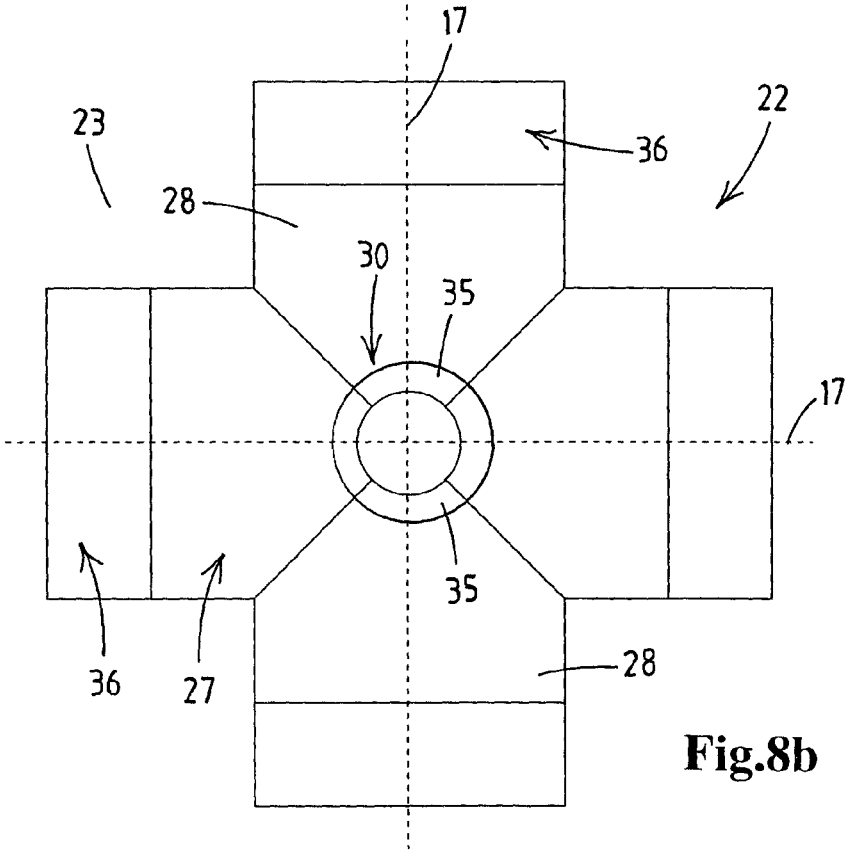

FIGS. 8*a* and 8*b* each show a top view of an alternative embodiment of a drilling vessel floor structure 22 and a tubular support assembly 24 of a drilling vessel according to the invention. The drilling deck 23, shown in top view, is provided with a cross shaped recess in which is located a support frame 26 with four support tables 27. The tables 27 have a top surface 28 that forms part of the drilling deck 23. The tables are supported such that their top surfaces 28 are substantially flush with the drilling deck 23, which is not shown in the top view depiction.

The tables 27 are each linearly guided by the support frame 26 to allow displacement along a substantially straight line 17 between an active position, shown in FIG. 8*a*, and a retracted position, shown in FIG. 8*b*. These lines of movement intersect at a common centre point. The common centre point coincides with the centre of the support opening, which is shown in FIG. 8*b*.

The tables 27 are each provided with a semi circular recess 29, which recesses face the common centre point such that when the tables are in their active position, the working position shown in FIG. 8*b*, the recesses together define a support opening.

The assembly further comprises multiple exchangeable adapter segments 35 for adapting the support opening to the size and shape of the tubular to be supported therein (not shown in FIGS. 8*a*, 8*b*). One adapter segment 35 is carried in each recess 29 of the support tables 27, such that, when the supporting tables are positioned in their active position, the exchangeable segments together form a bushing 30 for supporting the tubular.

FIG. 8*a* show a working position in which the tables, and the adapters segments supported thereby, are located in their retracted position. The bushing 30 is opened up for passing through an object through the opening between the support tables and the adapter segments they support.

In a preferred embodiment, at least part of the support frame 26 extends below the drilling deck such that the tables slide below the drilling deck when moved into their retracted position. Thus, no gaps or openings appear in the drilling deck at the locations 36 where the tables are positioned when in the retracted position. In an alternative embodiment, these openings are for example covered by one form ore hatch panels. In an alternative embodiments, panels are provided within or just below the support frame that are lifted, for example by hydraulic actuators, into the position left vacant by the tables moving into their active position, to provide a continuous drilling deck. By minimizing or even eliminating the gaps, crew members and tools are less likely to stumble or fall. An additional precaution to protect the crew can include fitting the drilling deck with a (removable) railing.

From the foregoing, it will be clear to the skilled person, that within the framework of the invention as set forth in the claims also many variations other than the examples described above are conceivable. For instance, the drilling vessel floor structure according to the invention is furthermore suitable for building a drill string, clamping the drill string segments with wigs in the bushing.

Other variations to the disclosed embodiments can be understood and effected by those skilled in the art in practicing the claimed invention, from study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere act that certain measures are recited in mutually different dependent claims does not indicate that a combination of these measured cannot be used to advantage. Any reference signs in the claims should not be construed as limiting the scope.

The invention is by no means limited to the exemplary embodiment described herein above, but comprises various modifications hereto, in so far as they fall within the scope of the following claims.

The invention claimed is:

1. A drilling vessel with a drilling deck, said drilling vessel comprising a drilling vessel floor structure defining the drilling deck, a riser spider and gimbal assembly that is recessed in the drilling vessel floor structure, wherein the riser spider comprises a support frame and at least two support tables, the support tables each having a top surface, wherein the tables are each guided by the support frame to allow displacement along a line between an active position and a retracted position, which lines of movement intersect at a common centre point, wherein the tables are each provided with a recess, which recesses face the common centre point when the tables are in their active position such that the recesses together define a support opening, wherein the gimbal is arranged between the riser spider and the drilling vessel floor structure, and moveably supports the support frame of the riser spider and the at least two support tables guided by the support frame, wherein the riser spider and gimbal assembly is recessed in the drilling vessel floor structure such that the top surface of the tables is flush with the drilling deck and thus forms part of the drilling deck, the riser spider and gimbal assembly further comprising multiple exchangeable adapter segments for adapting the support opening to the size and shape of the tubular to be supported therein, wherein at least one adapter segment is carried in each recess of the support tables, such that, when the supporting tables are positioned in their active position, the exchangeable segments together form a bushing for supporting the tubular, and wherein the tables and the adapters segments supported thereby are coupled, such that when the tables move from their active position into their retracted position each segment moves with the respective table it is coupled with and the bushing is opened up for passing an object through the opening between the at least two support tables and the adapter segments they support.

2. The drilling vessel according to claim 1, wherein at least one of the tables is provided with one or more guide rails along its top surface, which guide rails are positioned in line with guide rails provided on the drilling deck, for moving an object over the rails from a temporarily storage position on the drilling deck into an insert position above the support opening.

3. The drilling vessel according to at least claim 1, wherein locks are provided for locking the frame supporting the tables in a fixed position relative to the drilling vessel floor structure such that a top surface of each table is parallel to the drilling deck.

4. The drilling vessel according to claim 1, wherein the tubular support unit further comprises actuators-for moving the tables between their active position and their retracted position.

5. The drilling vessel according to claim 1, wherein the tables in their active position define a support opening having a diameter of about 60.5 inch for supporting a bushing that reduces said opening to about 49.5 inch or about 37.5 inch.

6. The drilling vessel according to claim 1, wherein the two tables in their retracted position define a pass through opening between the tables of at least about 80 inch between them such that a riser string insert can be passed through said opening.

7. The drilling vessel according to claim 1, wherein the central opening of the gimbal is at least about 80 inch such that a riser string insert can be passed through said opening.

8. The drilling vessel according to claim 1, wherein the tubular support assembly forms a unit that is removably mounted in the drilling vessel floor structure.

9. The method for constructing a riser string using a drilling vessel according to claim 1, the method comprising the steps:

providing multiple riser sections each having a coupling sleeve, adapted to be engaged by a riser spider, moving the tables into their respective active positions for defining the support opening, placing exchangeable adapter segments in the support opening such that each is carried in a recess of the support tables, which exchangeable segments together form a bushing, lowering a first riser section into the bushing and in a support position in which the flange at the top end of the riser section is supported by the bushing in the riser spider, attaching a second riser section to the top end flange of the riser section in the support position, lifting the first riser section from its support position, moving the tables, and thus the exchangeable adapter segment they each carry, towards their retracted positions, lowering the riser section through the opening between the tables, after the flange of the first riser section has been lowered through the opening, moving the tables into their respective active positions such that the exchangeable adapter elements carried by the tables again form a bushing, and lowering the second riser section into a support position.

10. The method for providing a riser string insert in a riser string according to claim 9, the method comprising the steps:

optionally: locking the frame supporting the tables against movement in a substantial vertical direction relative to the drilling vessel floor structure and in a position such that a top surface of each table is parallel to the drilling deck, moving a riser string insert from a temporarily storage position on the drilling deck into an insert position above a riser section in a support position, attaching the riser string insert to the top end flange of the riser section in the support position, lifting the riser section from its support position, moving the tables from their respective support positions into their respective retracted positions to allow passing of the riser string insert through the opening between the tables, lowering the riser string insert through the opening between the tables, and moving the tables from their respective retracted positions into their respective support positions to engage a flange of the riser string insert and supporting the riser string insert in a support position.

11. The drilling vessel according to claim 1, wherein the tables have a top surface that is flush with the drilling deck.

12. A drilling vessel with a drilling deck, said vessel comprising:

a drilling vessel floor structure defining the drilling deck, a riser spider and gimbal assembly for supporting tubulars, which riser spider and gimbal assembly is recessed in the drilling vessel floor structure, said riser spider and gimbal assembly comprising:

a riser spider comprising a support frame and at least two support tables, which support tables have a top surface that forms part of the drilling deck, which support tables are each guided by the support frame to allow displacement along a line between an active position and a retracted position, which lines of movement intersect at a common center point, and which support tables are each provided with a semi circular recess, which semi circular recesses face the common center point when the tables are in their active position such that the recesses together define a support opening in which they can together support a bushing for supporting a tubular, a gimbal arranged between the riser spider and the drilling vessel floor structure, which gimbal moveably supports the support frame and the at least two support tables guided by that frame, multiple exchangeable adapter segments for adapting the support opening to the size and shape of the tubular to be supported therein, wherein at least one adapter segment is carried in each recess of the at least two support tables, such that, when the supporting tables are positioned in their active position, the exchangeable segments together form the bushing for supporting the tubular, and wherein the at least two support tables and the adapters segments supported thereby are coupled such that when the support tables move from their active position into their retracted position each segment moves with the respective table it is coupled with and the bushing is opened up for passing through an object through the opening between the at least two support tables and the adapter segments they support.

13. The drilling vessel according to claim 12, wherein at least one of the tables is provided with one or more guide rails along its top surface, which guide rails are positioned in line with guide rails provided on the drilling deck, for moving an object over the rails from a temporarily storage position on the drilling deck into an insert position above the support opening.

14. The drilling vessel according to claim 12, wherein locks are provided for locking the frame supporting the tables in a fixed position relative to the drilling vessel floor structure such that a top surface of each table is parallel to the drilling deck.

15. The drilling vessel according to claim 12, wherein the tubular support unit further comprises actuators for moving the tables between their active position and their retracted position.

16. The drilling vessel according to claim 12, wherein the tables in their active position define a support opening having a diameter of about 60.5 inch for supporting a bushing that reduces said opening to about 49.5 inch or about 37.5 inch.

17. The drilling vessel according to claim 12, wherein the two tables in their retracted position define a pass through opening between the tables of at least about 80 inch between them such that a riser string insert can be passed through said opening.

18. The drilling vessel according to claim 12, wherein the central opening of the gimbal is at least about 80 inch such that a riser string insert can be passed through said opening.

19. The drilling vessel according to claim 12, wherein the tubular support assembly forms a unit that is removably mounted in the drilling vessel floor structure.

* * * * *